US007854660B2

(12) United States Patent
Crawford et al.

(10) Patent No.: US 7,854,660 B2
(45) Date of Patent: Dec. 21, 2010

(54) AMUSEMENT PARK RIDE PROVIDING FREE-FLYING EXPERIENCE

(75) Inventors: David W. Crawford, Long Beach, CA (US); Dana Scot Drake, Pasadena, CA (US); Aidan John Bradley, Westlake Village, CA (US)

(73) Assignee: Disney Enterprises, Inc., Burbank, CA (US)

( * ) Notice: Subject to any disclaimer, the term of this patent is extended or adjusted under 35 U.S.C. 154(b) by 445 days.

(21) Appl. No.: 12/033,073

(22) Filed: Feb. 19, 2008

(65) Prior Publication Data

US 2009/0209357 A1 Aug. 20, 2009

(51) Int. Cl.
*A63G 1/28* (2006.01)
*A63G 1/00* (2006.01)

(52) U.S. Cl. ..... 472/39; 472/130

(58) Field of Classification Search ..... 472/30, 472/39, 47, 59, 60, 130
See application file for complete search history.

(56) References Cited

U.S. PATENT DOCUMENTS

| | | | | |
|---|---|---|---|---|
| 2,282,763 | A * | 5/1942 | Kennedy | 472/39 |
| 2,468,893 | A * | 5/1949 | Orance | 472/39 |
| 2,819,899 | A * | 1/1958 | Thumberg | 472/39 |
| 3,104,103 | A * | 9/1963 | Mathias | 472/39 |
| 3,603,583 | A * | 9/1971 | Bartlett | 472/39 |
| 4,898,377 | A * | 2/1990 | Roche | 472/30 |
| 6,024,647 | A | 2/2000 | Bennett et al. | |
| 6,287,211 | B1 | 9/2001 | Bolliger et al. | |
| 6,405,655 | B1 | 6/2002 | Clerx et al. | |
| 6,513,441 | B1 | 2/2003 | Clerx et al. | |
| 6,776,722 | B2 * | 8/2004 | De-Gol | 472/59 |
| 6,782,831 | B2 | 8/2004 | Yamada | |
| 6,988,951 | B1 * | 1/2006 | Newman et al. | 472/39 |
| 2005/0014567 | A1 | 1/2005 | Li et al. | |

* cited by examiner

*Primary Examiner*—Kien T Nguyen
(74) *Attorney, Agent, or Firm*—Marsh Fischmann & Breyfogle LLP; Kent A. Lembke

(57) ABSTRACT

A vehicle for simulating flight in a park ride having a rotating drive with supports or radial arms. The vehicle includes a body with seats and passenger restraints. A connection assembly is used to attach the body to a support. The connection assembly includes a linkage assembly allowing the body to radially pivot inward and outward relative to the drive assembly based on the angle of the support arm and rotation rate of the drive assembly. The linkage assembly translates radial movement of the body into rotation of the body about a pitch axis. The pitch axis extends through or proximal to the center of mass of the body, and the pivotal connector that supports the vehicle in a pendular manner is spaced apart and above the center of mass. The linkage assembly may include one or more four-bar linkages to provide two degrees of freedom of the body relative.

20 Claims, 11 Drawing Sheets

AMUSEMENT PARK RIDE PROVIDING FREE-FLYING EXPERIENCE

BACKGROUND OF THE INVENTION

1. Field of the Invention

The present invention relates, in general, to amusement park rides and other entertainment rides such as round iron rides, and, more particularly, to vehicle and amusement or theme park rides configured to provide passengers with ride experiences simulating free flight or relatively unrestrained flying experience such as, but not limited to, the passengers being placed in a prone or face-down position (e.g., inclined at least partially forward from vertical during a portion of the ride).

2. Relevant Background

Amusement and theme parks are popular worldwide with hundreds of millions of people visiting the parks each year. Park operators continuously seek new designs for rides that attract and continue to entertain guests. Many parks include round iron rides that include vehicles or gondolas mounted on support arms extending outward from a centrally located drive or rotation assembly. The guests sit in the vehicles and are rotated in a circle about the drive assembly, which spins about its central axis. In some of these rides, the guests may operate an interactive device, such as a joystick in the vehicle, to make the support arm and their attached vehicle lift upward and, later, drop back downward.

While these rides are often very popular with younger children, these rides are typically not considered a thrill ride for the older guests as the rides often rotate at less than 10 revolutions per minute (RPM). When designing new rides, park operators have a great amount of freedom to develop thrill rides with very different configurations such as roller coasters and the like that allow the guests to travel at high speeds and experience high accelerations as their vehicles travel around corners and dips. However, park operators face a different challenge when they attempt to refurbish or modify an existing round iron ride to create a ride that will attract older guests but that yet can be provided in the same space constraints or have the same footprint, i.e., a ride provided within the same circular area used by the original round iron ride. Even more attractive to the park operator would be a ride configuration that made use of at least some of the original ride components such as the circular drive assembly as this significantly reduces start up costs and allows continued use of a proven drive system. However, the relatively low rotation rate of the drive assembly and fixed seating orientation of the guest has been a significant barrier to the amount of thrill or excitement that could be provided with a ride based on a round iron ride design.

SUMMARY OF THE INVENTION

The present invention addresses the above problems by providing a vehicle assembly for use in amusement park rides such as with round iron rides. The vehicle assembly is mounted upon the ends of support arms extending radially outward from a central drive and support assembly. During typical operations, the support arms are positioned at a base or loading height while guests enter the vehicle assembly and the drive assembly first moves vertically to lift the support arms as well as the attached vehicles upward to an initial/first or minimum height. Then, the drive assembly begins to rotate about its center axis causing the support arms also to rotate such as at a constant or, in some cases, variable rotation rate (e.g., up to 10 to 20 RPM or more with 8 to 10 RPM being a typical range of operation for many existing round iron ride designs). In some embodiments, the vehicle includes an interactive device such as a joystick or lever in or accessible from the vehicle assembly to cause the support arm supporting their vehicle to move from the initial height through a range of heights including an intermediary height up to a second or maximum height.

Significantly, the vehicle is mounted to the support arm (such as at its end) with a connector or connection assembly that functions to pivot the vehicle body from a loading orientation in which the guests or riders are typically substantially vertical to a forward leaning or more prone orientation such as into a pitch angle of 0 to 90 or more degrees. The pitch angle in some cases is less than about 70 degrees with about 40 to 50 degrees maximum pitch being used in some applications to provide desired guest comfort during a free flying experience. The connection assembly may provide a pendulum type attachment to the support arm such that the body can move radially (such as about one or more pins or the like) based on the position (or angle) of the arm and the angular velocity of the vehicle, and this radial movement is translated into a pitch movement that causes the vehicle body to rotate forward about an axis (e.g., a vehicle pitch axis). In one embodiment, pitch generated by the connection assembly is proportional to the height of the vehicle and, hence, the higher the vehicle the greater the pitch, e.g., from a minimum pitch at the minimum or initial height to a maximum pitch at the maximum ride height.

More particularly, a vehicle is provided for use in an amusement park ride that may be, for example, a round ride design with a drive assembly that rotates about a central axis and supports a plurality of supports that extend radially outward (such as support arms positioned at angles above and below horizontal). The vehicle is adapted to provide a free flying experience for passengers and includes a body with at least one seat for a passenger. A connection assembly is also provided in the vehicle to attach the body to a support. The connection assembly may include a linkage assembly that allows the body to pivot radially inward and outward relative to the drive assembly or its central axis. The linkage assembly further acts to translate the radial movement or pivoting of the body into a second direction of body movement such as a rotation of the body about a pitch axis. The pitch axis may be transverse to an axis about which the body radially moves or pivots, and the pitch axis in some embodiments extends through the vehicle through or proximal to the center of mass of the body (unloaded and/or loaded with one or more passengers).

The linkage assembly may include a pivotal connector that links the body to a support and the radial pivoting of the body may occur about an axis passing through this connector (e.g., through or near one or more pins used to mount the body to a support). The pivotal connector is in some cases spaced apart from the center of mass of the body, with the body being pivotally supported (or in a pendular manner) from above by the pivotal connector. The linkage assembly may include one or more four-bar linkages such as to provide two differing degrees of freedom of movement of the body relative to the support of the drive assembly (e.g., radial movement and a pitch or rotation movement about a differing, transverse axis). The linkage assembly may include an arm or extension member that is rigidly attached to the support and further include a connector vertically supporting the body upon the arm in a pendular manner to allow the body to move inboard toward the drive assembly and outboard away from the drive assembly. The inboard and outboard movements occur based upon an angular orientation of the support (e.g., present angle of a support arm below, at, or above the horizon or the like) and also based upon a rate at which the drive assembly rotates (e.g., an angular velocity of the vehicle that effects centripetal forces experienced by the vehicle body) as well as other factors such as length of the support. Further, the linkage assembly may include a bar attached to the arm/extension member at a first end with a spherical or ball joint and to a portion of the body at a second end with another spherical or ball joint (e.g., a portion of the body distal or spaced apart from the pivotal connector and arm that may include a crank arm). The bar or tie bar may extend transverse to the pitch axis and/or to the axis about which the body radially rotates in response to a height/angle of the support and speed of rotation.

According to another aspect, a ride apparatus is provided for giving guests or passengers a flight experience. The apparatus includes a drive assembly with a structure rotatable about a central axis at one or more rotation speeds and the structure includes a number of support arms extending outward from the structure. A plurality of vehicles is included and each is mounted on or proximate to the ends of the support arms. Each of the vehicles has a body with at least one passenger seat and a connection assembly for mounting the vehicle to the support arm with two degrees of freedom. The degrees of freedom allow the body to have radial movement (or pivoting about a pin or similar connection to the support arm) and to have a forward pitch of the passenger seat to place the passenger in a more prone or prone position (e.g., as if in horizontal flight or the like). The radial movement occurs (or has a magnitude selected) based on an angle of the support arm and the rotation speed of the drive assembly structure.

The passenger seat may include a substantially planar back support that supports a passenger's back, and the forward pitch may be provided by the connection assembly at less than about 90 degrees as measured from a vertical plane and the back support. The drive assembly may operate to position the support arms in a number of positions such as a minimum height operating position with the support arms at a first angle relative to horizontal or a horizontal plane and such as a maximum height operating position that is above the minimum height operating position. In this maximum height operating position, the support arms are at a second angle relative to horizontal that is greater than the first angle. The forward pitch at the minimum height position may be less than about 10 degrees while at the maximum height the forward pitch may be between about 10 and 60 degrees (or up to 90 degrees or more in some cases). The rotation speeds in some cases may be less than about 15 RPM (such as 8 to 10 RPM or so), and in such cases, the radial movement at the maximum height position may be an inboard rotation of the body toward the drive assembly. The connection assembly may respond to such movement by generating the forward pitch of the passenger seat.

BRIEF DESCRIPTION OF THE DRAWINGS

FIGS. 4-6 show all arms and vehicles operating in like positions but this is not required to practice the invention and, in fact, some preferred embodiments include a height adjustment lever or joystick that a guest or passenger can operate to move from the initial or minimum height position to the intermediary position to the maximum operating position (and positions between these operating modes));

DETAILED DESCRIPTION OF THE PREFERRED EMBODIMENTS

Figure 1:
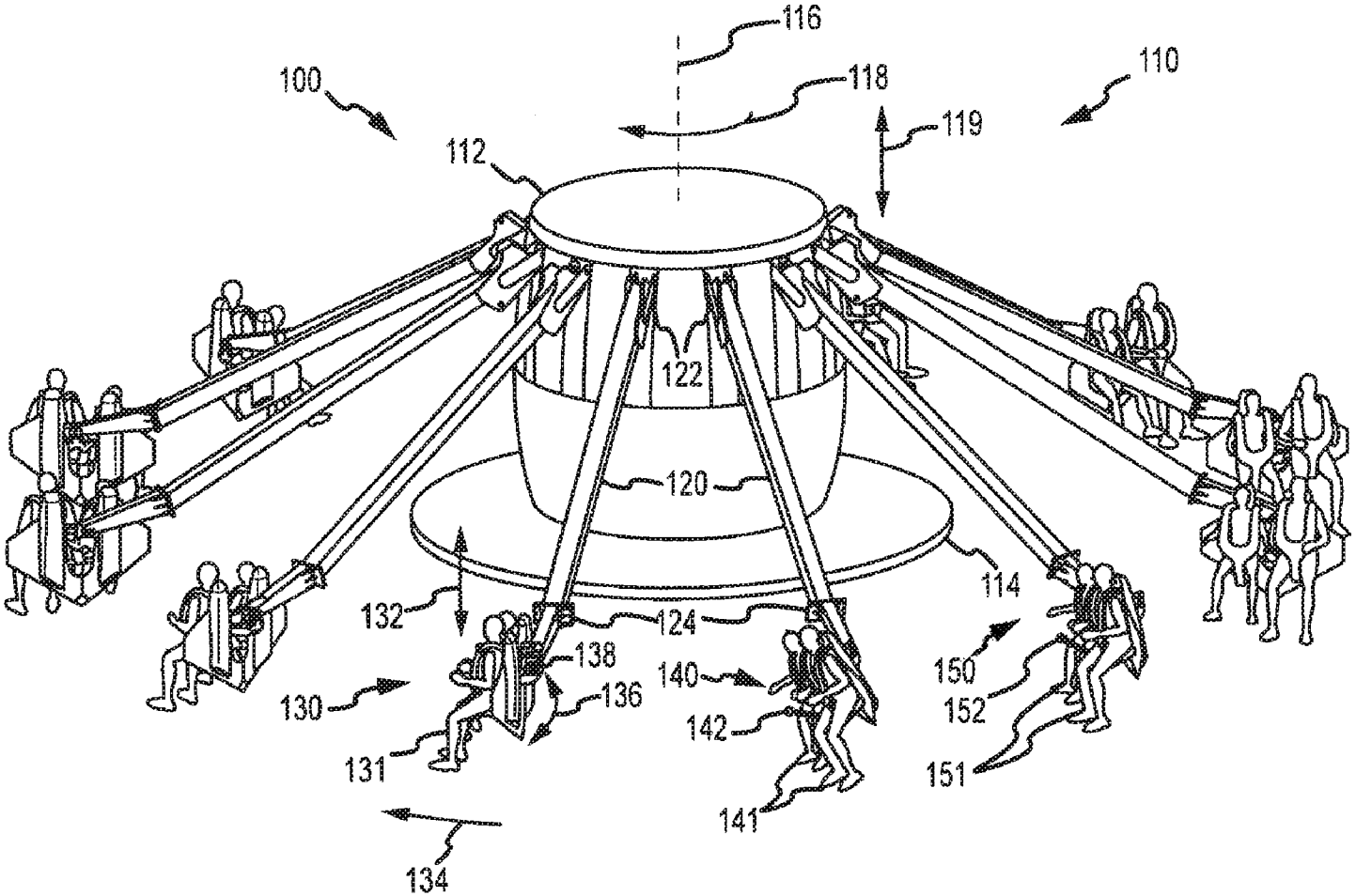
FIG. 1 is a perspective view of a theme or amusement park ride (or, more simply, park ride) configured according to an embodiment of the invention during operations, e.g., after or during initial loading and rotation of the drive and support assembly.

Embodiments of the present invention are directed to an amusement park ride and vehicle configurations for such a ride that provides a guest or rider the sensation or experience of free flight. For example, one embodiment simulates movements or motions that may be obtained with a jet pack including lift off and flight in a leaning forward or prone position. More specifically, the inventors recognized an opportunity to increase the thrill level and, therefore, attractiveness to a larger portion of the population of rides built upon the round ride infrastructure (e.g., central drive and lift system with radially extending support arms). The inventors describe herein a modification to round rides to include a unique vehicle assembly that is attached to or linked to the support arms with a free pivoting connection.

The connection includes a special linkage that links parameters such as rotation speed or angular velocity, elevation and/or angle of the support arm, and weight of the vehicle and its passengers/guests (e.g., force of gravity) to the pitch angle of the vehicle body (e.g., angle of backrest or other portion of vehicle relative to a vertical plane). The ride is configured for a relatively standard vertical loading position for the vehicle body, in some cases, but then to pivot from this initial loading pitch angle (such as 0 to 20 degrees from vertical) through intermediate pitch angles to a maximum pitch angle. This enhances loading when compared to roller coasters and other rides that force guests to load into a vehicle in a prone or flying position and, in which they typically remain for the entire ride. In some extreme cases, the pitch angle may not be limited (e.g., be 360 degrees) but more typically the pitch angle provided by the connection is designed to have a maximum pitch angle such as to place the passenger in a prone or horizontal position (e.g., less than about 80 to 100 degrees) or to a position that provides the sensation of flying at horizontal such as 40 to 60 degrees or less (e.g., 45 to 55 degrees or the like). The greater pitch angles occur when the support arm rises to its higher or maximum heights, such as in response to a passenger moving a joystick or other device or by automatic functioning of the drive system to lift and lower the support arms and attached vehicles.

As will be explained in detail below, the preferred embodiments of the connection assembly translate pivoting of the vehicle in a radial direction (radially inward or outward relative to the central axis of the rotating drive assembly) into the pitch of the vehicle (or pivoting the vehicle about an axis passing through or near the center of gravity of the vehicle) without use of actuators such as mechanical, hydraulic, or electric actuators. Such a "free" pivoting connection provides a unique flying experience that is much less rigid or mechanical in nature with motion being generally based upon the location of the center of gravity of the vehicle and applied forces such as centripetal force and gravity. In one embodiment, no power is input to pivot the vehicle into the flying positions or into a range of pitch angles and translation of angular movement to pivoting about a pitch axis is provided by a four-bar linkage providing the vehicle with two degrees of freedom during rotation of the drive assembly.

FIG. 1 illustrates a ride 100 according to one embodiment of the invention for providing a free flying experience to guests or passengers. One of the exciting aspects of the invention is that the vehicles described can be used to retrofit a variety of existing drive systems and are generally useful for nearly any drive system that provides a round ride experience such as with a centrally positioned and rotatable drive device that includes structures or arms or similar mechanisms for supporting a plurality of the inventive vehicles such as in a circular pattern about the central axis of the drive assembly. As one useful, but not limiting example, the ride 100 may include a drive and support assembly 110, which may be configured as for a typical round iron ride such as the drive and support assemblies designed and distributed by Zamperla Inc., 49 Fanny Road, Parsippany, N.J., USA or other similar ride design and production companies. Often, such an assembly 110 only operates at relatively low speeds such as less than about 20 RPM and more typically less than about 10 RPM such as about 9 RPM in some cases. The vehicle designs provided by this description are well suited for use with these low RPM drive assemblies 110 to provide a sensation of flight without the need for high centrifugal forces.

The ride 100 includes the drive and support assembly 110 with a center support structure 112 that is positioned upon a based 114. The support structure 112 is adapted to move vertically as shown with arrow 119 from a loading position (or lower first position) to one or more operating positions. The support structure 112 is also adapted to drive the ride by rotating as shown with arrow 118 about its center or central axis 116. The speed at which it rotates may be relatively high such as up to 30 RPM or more but, in more common applications, the rotation 118 will be less than 20 RPM and more typically less than about 10 RPM. Also, the rotation 118 may be a constant rate or it may be varied during the course of the ride. In some cases, the rotation 118 may be in either direction, but, more typically, the ride structure 112 rotates 118 in a single direction, which allows the vehicles to be provided to better simulate forward flight.

The ride 100 includes a number of support arms 120 that are mounted at a first end 122 to the ride structure 112 and extend outward radially from the axis 116. The arms 120 are shown to be linear with a rectangular cross section but many other configurations may be used to practice the invention, such as circular cross section arms with a non-linear shape (e.g., wavy, curved, or the like), and the length of the arms typically is 0 to 30 feet or more. A main function of the support arms 120 is to provide a rigid or relatively rigid connection between the ride structure 112 and a set of vehicles (such as vehicles 130, 140, 150 and the others shown in FIG. 1). In some embodiments, the arms 120 are pivotally mounted at ends 122 such that the angle of the arm 120 may be changed by the structure 112 during the ride, e.g., in response to operation of an interactive device or joystick 142, 152 in the vehicle, in response to manual commands by a ride operator, in response to a ride program/signals, or the like. This change in arm angle is shown with arrow 132 and causes the second or distal end 124 of the arms (and attached vehicles) to move between an initial or minimum operating (or non-loading) height and an upper or maximum operating height.

Figure 2:
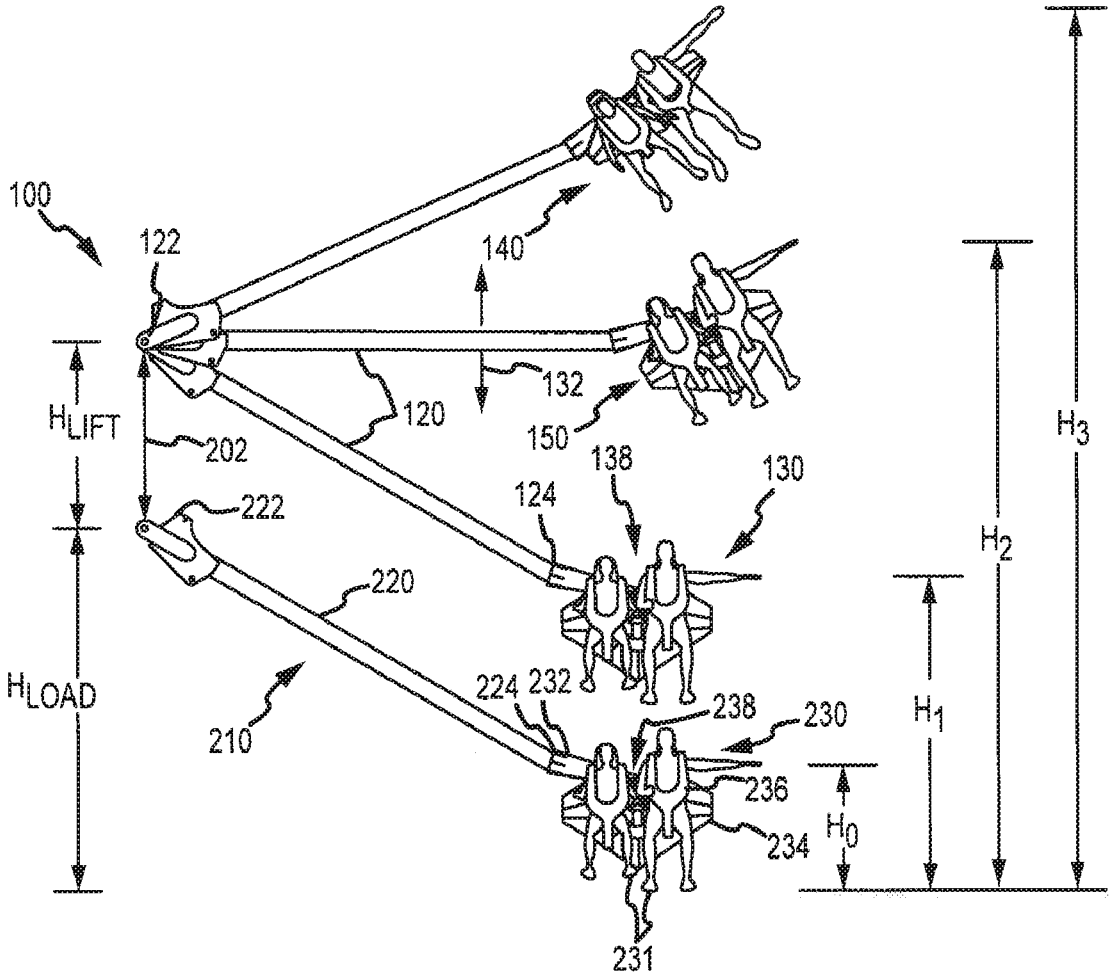
FIG. 2 illustrates a partial side view of an operating park ride illustrating operational modes or positions for the vehicles and drive and support assembly including loading, a lowest operating position for the support arm and attached vehicle, an intermediate position or height, and a highest operating position.

During operations, the ride structure 110 rotates about the axis 116 and the arms 120 and attached vehicles move at a particular velocity as shown with arrow 134 (which may be expressed as angular velocity, tangential velocity, or the like). At the ends 124 of the arms 120, vehicles are mounted and are moved with the arms 120 at the angular velocity 134. In FIGS. 1 and 2, three vehicles or vehicle assemblies 130, 140, 150 are shown in three differing operating mode or at differing pitch angles. The vehicle 130 is attached to the end 124 of the arm 120 with a connector or connection assembly 138 that is adapted to allow the vehicle body and passengers 131 to pivot 136 to move radially, e.g., a pin mounting or other mounting that allows radial movement like a device on a pendulum. In this manner, the body of the vehicle 130 can freely respond to forces of gravity and centripetal forces created by the angular velocity 134. For example, at lower speeds 134 the vehicle 130 may rock inward as the arm 120 is raised 132 while at higher speeds 134 the vehicle 130 may rotate or pivot radially outward away from the axis 116. The vehicle 130, however, is shown with its support arm 120 in a lower or even a lowest position, and the vehicle body may be at a substantially initial position during rotation 134 at the lower angle of the arm 120 and corresponding height of the vehicle 130 (and end 124). In the illustrated embodiment, this initial position corresponds to a pitch angle of about zero degrees, e.g., a plane extending through the back support or rest of the vehicle 130 is substantially vertical or parallel to the center or rotational axis 116 of the ride 100.

In one embodiment, the vehicles 130, 140, 150 are provided two degrees of freedom with the connection assemblies 138, and one is in the radial direction 136 and the other is a pivoting about an axis that passes through or near the center of gravity to place the vehicle body and its passengers in a pitch angle relative to vertical. In this respect, the vehicle 130, 140, 150 may be configured such that at lower positions the vehicle is as shown at 130 in a substantially vertical position or very small angle. In the other extreme, the vehicle 140 may be pivoted into a "prone" position or at a maximum pitch angle such as up to 90 degrees or more but more typically an angle less than about 70 degrees such as less than about 50 degrees. Such pivoting may occur in response to the passengers 141 operating a joystick or other interactive device 142 to cause the arm 120 to rise up to a higher or maximum angle and corresponding height of end 124 and attached vehicle 140. The vehicle 140 has two degrees of freedom and the pitching movement or freedom typically is created as a translation of the radial movement 136, such as through a 4-bar linkage or other translational mechanism (e.g., maximum pitch may be created by a corresponding large or maximum amount of radial movement inward or outward, depending upon the configuration of the vehicle). The specific magnitude of the pitch may vary vehicle to vehicle on a particular ride due, in part, to the weight of the passengers 141 and other mechanical factors such as friction and wear. In between the positions of vehicles 130, 140, the passengers 151 may be in a vehicle 150 that is at an intermediate pitch and intermediate angle of the arm 120 and height of vehicle 150. This intermediate pitch angle may be achieved by operating the joystick 152 to control the height of the arm 120 such that the radial movement is less than for vehicle 140 but greater than for vehicle 130 (e.g., an intermediate radial movement of vehicle 150 is translated into a forward rotation or pitch of the vehicle 150 that is in between these two pitch angles such as an angle between 0 and 50 degrees or more relative to vertical).

Figure 3:
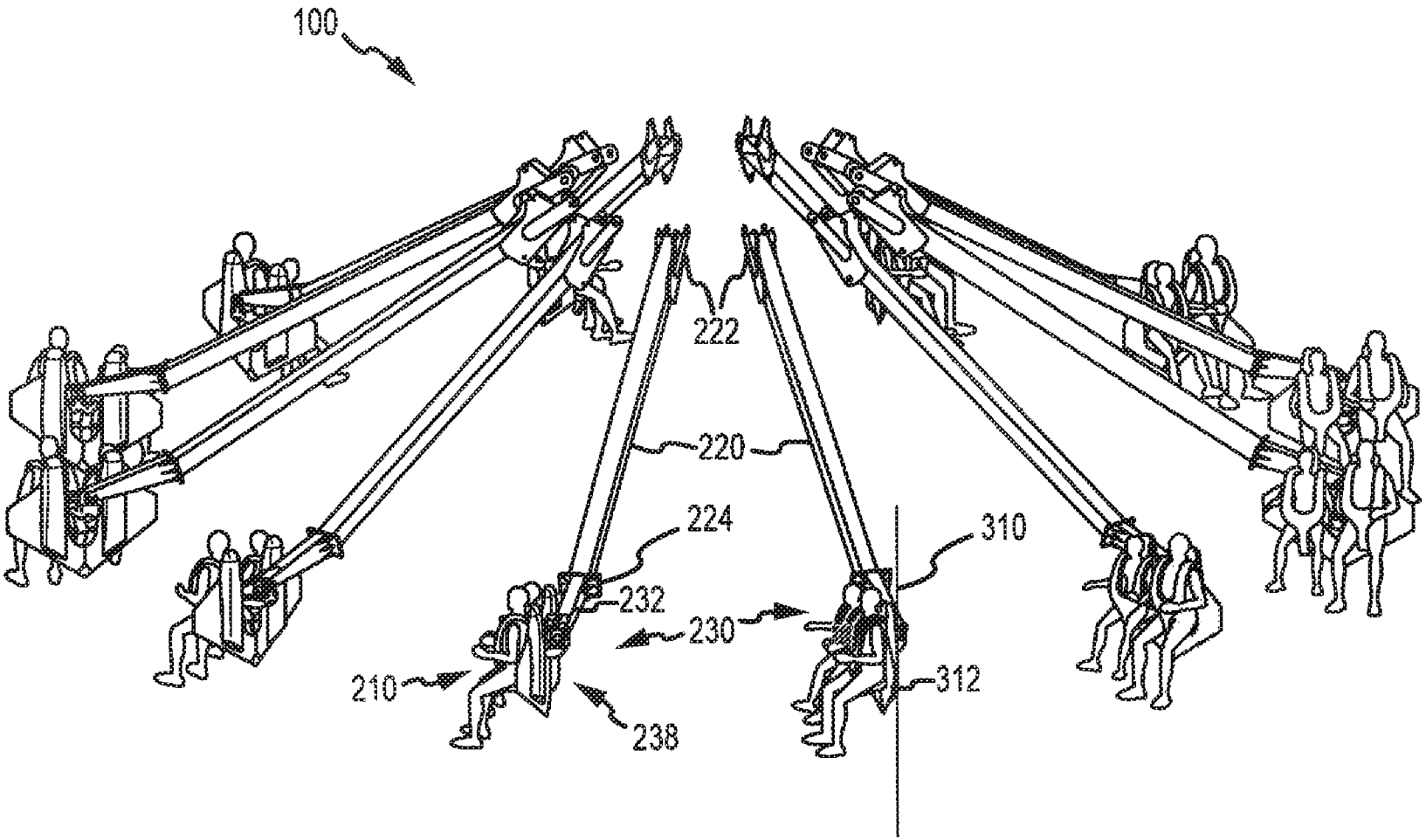
FIG. 3 illustrates a partial perspective view of a park ride according to an embodiment of the invention operating with the support arms and vehicles in loading or base operating position.

FIGS. 2-6 illustrate operation of the ride 100 with further illustration of various positions of the support arm and ride vehicles. FIG. 2 illustrates a loading position 210 of the arm 220 and vehicle 230. As shown, the inner or first end 222 of the support arm 220 is positioned at a first or load height, HLOAD, such as by operation of the ride structure 112 in FIG. 1 to drop down to or toward the base 114. The ride 100 in this loading position/operation is also shown in FIG. 3. The end 222 would be mounted to the ride structure 112 and the arm 220 extends outward to a second or distal end 224. The arm 220 is shown at a loading angle that may be a negative angle relative to a horizontal plane passing through end 222 but in other cases the loading angle may be about zero degrees relative to horizontal or even a positive angle. In the position 210, the passengers 231 are able to enter the vehicle 230, which is positioned at a loading or original height, H0, that allows the passengers 231 to step easily into the vehicle 230 from a loading platform (such as less than about 3 to 5 feet as measured generally from the center of the vehicle or the seat of the vehicle 230).

As shown in FIG. 3, during loading 210, the back support or rest (or a plane passing through such components or even though the nacelle) 312 is at a pitch angle that is small or substantially vertical. The vehicle 230 is mounted to the support arm end 224 with a connection assembly 238 that may include a rigid support, arm, or link 232. The connection assembly 238 is configured as discussed below with reference to FIG. 7 to allow two degrees of freedom including a pendulum-like mount to arm 232 to allow radial movement or pivoting about the attachment of the body relative to arm 232 and also including a pitch movement or pivoting about an axis that extends through the vehicle body such as at or near the center of gravity in a plane parallel or substantially parallel to a plane containing the arm 220. The vehicle 230 is shown to include the back support/nacelle structure 312 and also to include decorative features 234 such as wings of a jet, jet pack, bird, or the like as well as a passenger restraint 236.

Figure 4:
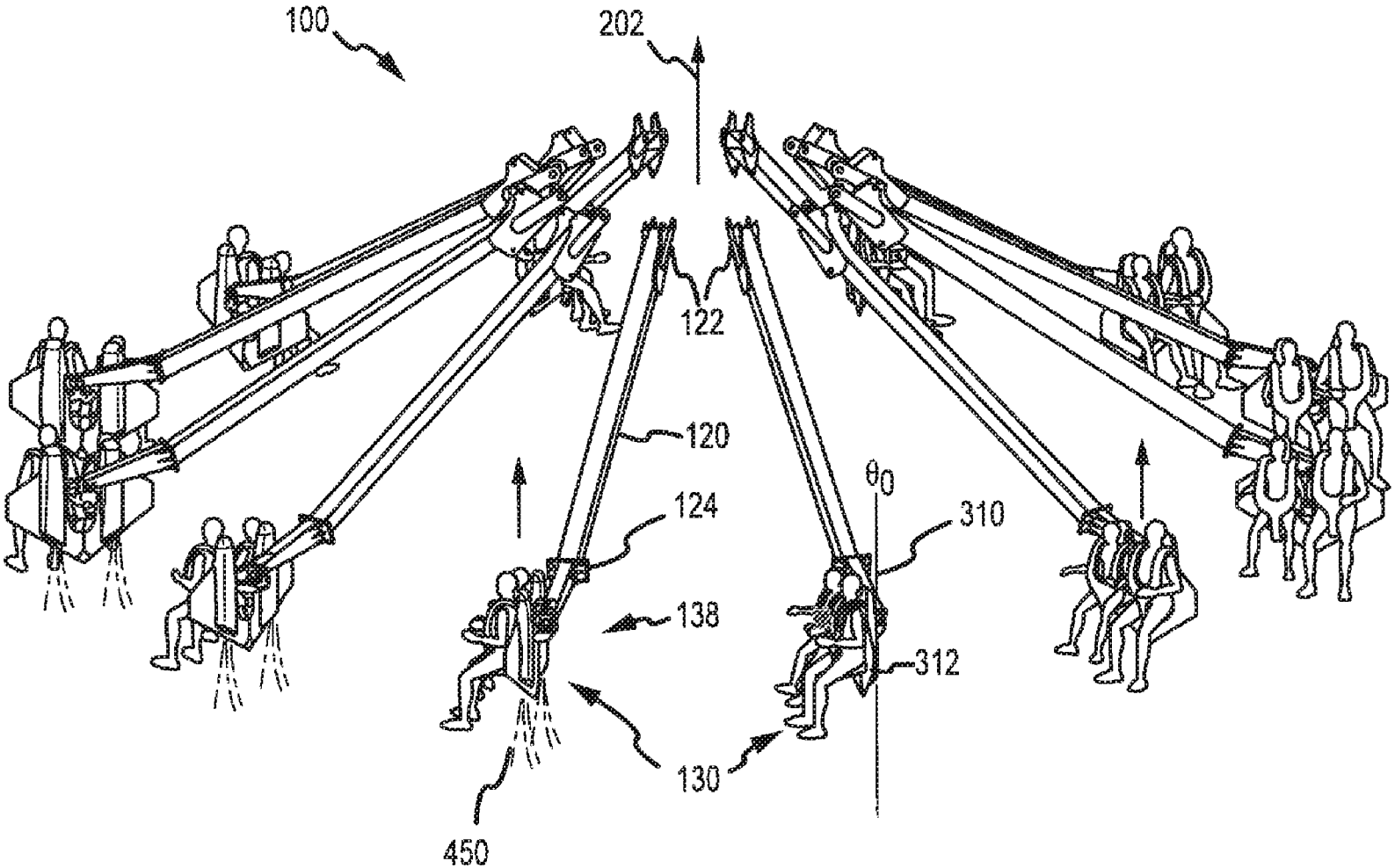
FIG. 4 illustrates a partial perspective view of a park ride according to an embodiment of the invention operating with the support arms and vehicles in a lowest or initial operating position after "lift off" when the support arms are elevated from the loading position by operation of the central drive and support assembly (or a separate lift actuator provided separately from the rotational drive that lifts the arms vertically)

After loading at 210, the ride 100 is operated to provide a lift (or lift off) from the loading height to a second (or more) operating height. Note, lift off is not a required part of operation of a ride 100, but it may be used in specific implementations to clear the guests' feet from the ground/loading platform. This could also be done by lowering/moving the loading platform/floor to create space to allow for rotation to begin with or without a lift off sequence. As shown in FIG. 2, the first or inner ends 122 are lifted as shown with arrow 202 through a lift distance or height, $H_{LIFT}$, such as by operation of the ride structure 112 from the base 114 to one or more positions for use during rotation 118 about its center axis 116 (as seen in FIG. 1). In the embodiment shown, but not as a limitation, the arm 120 supporting the vehicles 130 remains at the same angle relative to horizontal as used for loading, and the lifting of the first or inner end 122 causes the second or distal end 124 to also be lifted, which causes the vehicle to move to a first or initial operating height, $H_1$. In some embodiments, as shown in FIG. 4, the vehicle 130 is adapted to provide special effects associated with the ride such as a smoke/fog, lights, and/or noises associated with the ride theme, e.g., noises, lights, smoke, and the like may be generated by the vehicle body similar to lift off of a jet pack with FIG. 4 illustrating discharge of exhaust 450 during lift off (or core/drive structure 112 movement) to the initial position 130 as shown with arrow 202.

In the initial position, the ride 100 would then be operated to rotate the support arms 120 and the attached vehicles at a particular rotation rate (such as less than about 10 RPM or the like). The initial pitch angle, $\theta_0$, as measured from vertical shown with arrow 310 to the location of the back support or other structure of the vehicle body, may be zero degrees or a small magnitude of pitch may be imparted based on the speed of rotation and/or the weight of the passengers and vehicle, e.g., an angle of 0 to 20 degrees or the like. In some embodiments, the vehicle 130 and the pivoting connection assembly 138 are configured such that when the arm 120 is in the initial lift and/or operating position (e.g., vehicle 130 is at the lower, initial height, $H_1$) the vehicle 130 has little or no pitch (or forward lean) and, in some cases, little or no radial movement (e.g., outward or inward rotation relative to its mounting to arm end 124). In rides 100 where the riders can select the angle of the arm and corresponding height of the vehicle 130, the mode shown in FIG. 4 represents a less thrilling or more vertical position that the riders can return to if or when the riders want a change from the flying experience. The vehicle 130 shown in FIG. 4 is also shown with the arm 120 in an end of ride position that the support structure 112 would return to by lowering all arms 120 and then moving back down through the lift height, $H_{LIFT}$, to the load height, $H_{LOAD}$.

Figure 5:
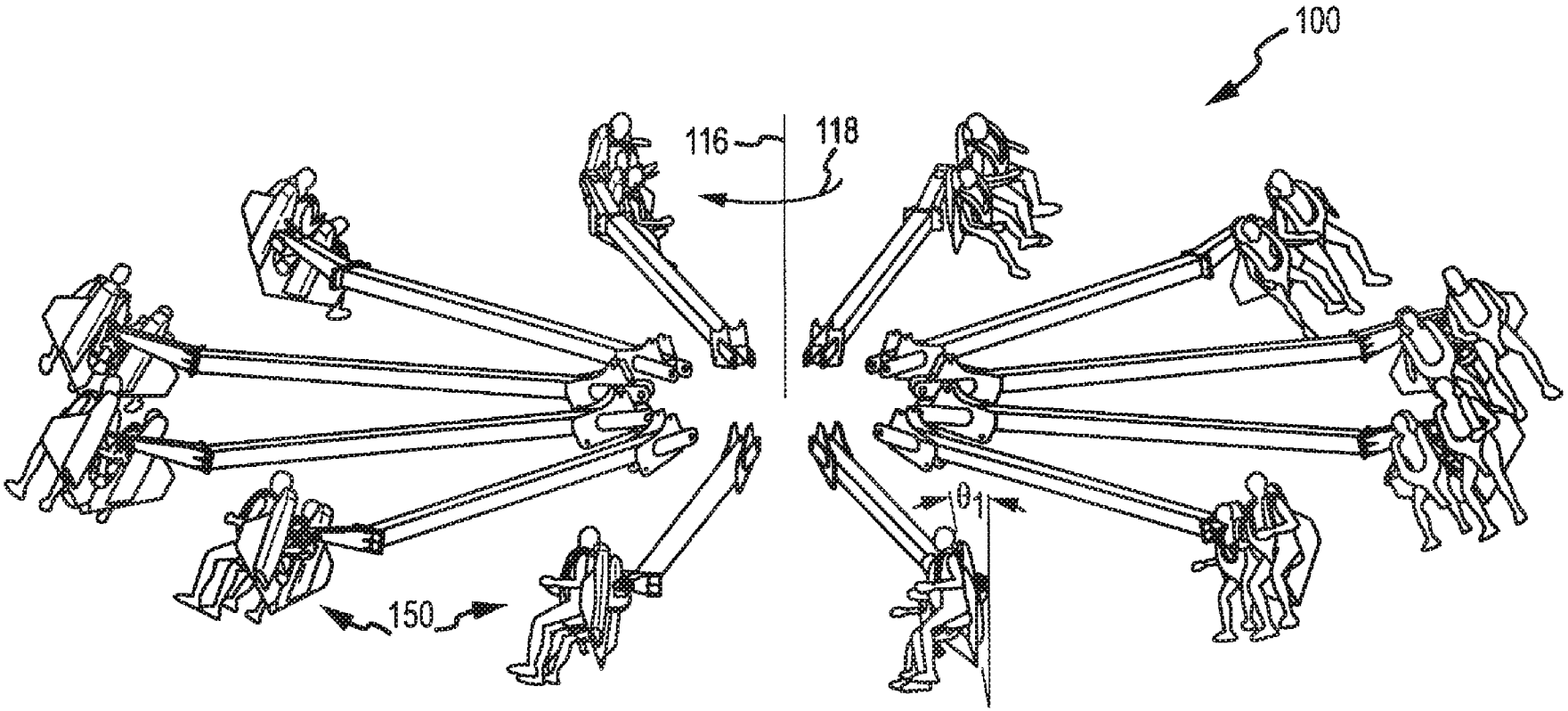
FIG. 5 illustrates a partial perspective view of a park ride according to an embodiment of the invention operating with the support arms and vehicles in an intermediate or secondary operating position.

Referring now to FIGS. 2 and 5, the vehicle 150 is in an intermediary position with its support arm 120 moved to an angle above the arm supporting the vehicle 130. As shown, the arm 120 supporting vehicle 150 is at about horizontal, and this results in the vehicle 150 being raised to a second or intermediary height, $H_2$, above the ground. In some embodiments, the riders can adjust as shown with arrows 132 the location of the arm 120 to select the first height, $H_1$, a second or intermediate height, $H_2$, or a third or maximum height, $H_3$. At the new angle of the arm 120 and at the rotation rate 118 about the central axis 116, the vehicle 150 may pivot or rotate in a radial direction. If so, this radial pivoting is also typically translated by a connection assembly into a rotation about a pitch axis to place the vehicle 150 at a pitch angle, $\theta_1$, that is greater than zero such as up to about 50 degrees or more as measured from a vertical plane to the back support or other portion of the vehicle body. Depending upon a number of parameters (such as angle of the arm, weight of the vehicle and passengers, and the like) and the design of the connection assembly and the vehicle 150, the pitch angle, $\theta_1$, may still be zero or near zero with little or no radial movement yet occurring. In some preferred embodiments, the vehicle 150 with its connection assembly is adapted such that some upward movement of the arm 120 and vehicle 150 may occur without a change of the pitch, and a transition height (or arm angle) exists for the ride. Above this transition height/transitional arm angle (or "tipping point"), the radial movement of the vehicle body causes or is translated into a pitching forward or rearward of the vehicle 150 (but, in some cases, this tipping point may be provided near or immediately above the initial position/height/angle shown in FIG. 4 for vehicle 130). As discussed above, the rotation rate 118 may be the same for vehicle 150 (e.g., many round rides operate at a relatively constant angular velocity with only the arms position being changed) or be a different rate such as a higher RPM in a later stage of operation of the ride 100.

Figure 6:
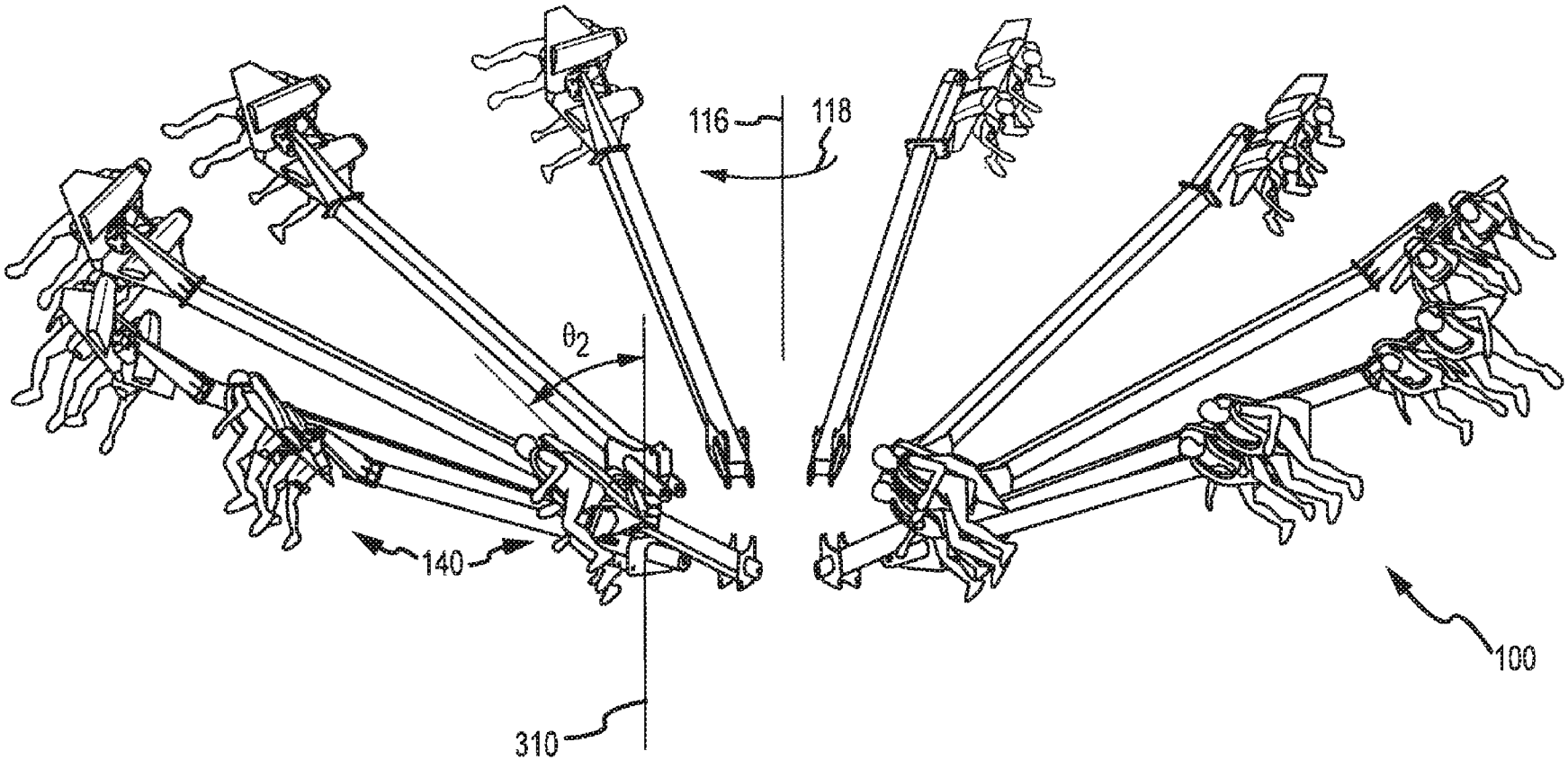
FIG. 6 shows a partial perspective view of a park ride according to an embodiment of the invention operating with the support arms and vehicles in a highest or maximum operating position (note.

FIGS. 2 and 6 also show vehicles 140 that are at a third or maximum height, $H_3$. For example, this position of vehicle 140 may be achieved by the ride 100, automatically or in response to a rider input via a joystick or the like, raising the arm 120 supporting the vehicle 140 to an upper most position with a maximum angle (e.g., 0 to 45 or more degrees from horizontal). The rotation speed 118 about axis 116 may also change (increase or decrease relative to when the vehicle is at position 150) or, more typically, be held constant with only the position of the arm 120 and vehicle 140 changing. As shown in FIG. 6, the vehicle 140 has rotated to a new pitch angle, $\theta_2$, that is greater than the intermediary pitch angle, $\theta_1$, and may be at or near a limit such as a limit of up to or exceeding 90 degrees from vertical 310 but more typically less than about 70 degrees such as 30 to 60 degrees. This pitch of vehicle 140 is generated by a translation of radial movement such as a rotation inward of the vehicle body or a rotation outward and the amount of radial movement is typically dependent upon a number of factors such as the vehicle design and weight, weight of passengers, angle of the arm 120, and mounting arrangement or mechanism provided in connection assembly as well as the rotation speed 118 (e.g., centripetal force acting on the vehicle 140 and its passengers). With the arms full up as shown in FIG. 6, the riders are placed in the most extreme flying position, and this position may be varied to practice the invention with a prone or horizontal position typically being a useful maximum for the pitch angle, $\theta_2$, while passenger comfort may indicate that a pitch angle, $\theta_2$, of less than about 50 degrees is more desirable.

As can be seen from the description above, one useful embodiment of rides of the invention is for jet pack rides or other similar flight rides that are built upon round ride drive systems. The ride vehicles may be custom vehicles configured and/or themed to match the ride intent such as to give the rider the feel that they are strapping on a jet pack or booster rocket, strapping into a hang glider, or the like. The vehicles may be attached to existing ride/attraction support arms after removal of existing vehicles. Significantly, the vehicle bodies are attached using a custom linkage connector that functions to control pitch of the vehicle and guests in such vehicles. Embodiments of custom linkage connectors are discussed further below. During loading, the vehicle or seats/back supports in such vehicles may be vertically arranged to allow typical load/unload processes. Once in operation (e.g., after loading is complete and lift off has occurred), the pitch angle of the vehicle (or the seat/back support) varies depending on the vehicle elevation and/or arm angle. At the highest vehicle elevation and, hence, arm angle, the vehicle pitch may be up to 90 degrees or more with some embodiments providing a limit of 50 degrees forward pitch (which may be limited structurally with stops or the like or be a soft limit provided generally by the connector and/or vehicle design based upon loading and vehicular angular velocity assumptions).

The vehicles may include a variety of equipment or components to provide desired functions. For example, an interactive control may be desired and a device such as a joystick may be included within reach of the guests to provide them control over vehicle elevation, which, in turn, controls pitch. It is, of course, desirable to restrain the passenger but the particular components used may be varied widely to practice the invention. In some cases, a Class 5 restraint as described, for example, in ASTM 2291 is used in the form of an over-the-shoulder restraint. Padding may be provided to account for movement to the prone or near prone position as well as a head rest and other desired padding. The restraints may be electrically locked and, in some cases, monitored during the ride for proper operation. The restraints may be manually lowered and sprung open. Pitch control is provided by one or more connectors/connection assemblies such as mechanical assemblies that pitch the vehicle and guests about a pitch axis an amount relative to a particular arm angle and/or vehicle elevation and speed. Theme-based special effects may be provided such as on-board lighting (e.g., LED lighting in the exhaust to simulate a flame and/or a fog/smoke generation mechanism such as may be used at least at lift off and, in some cases, during the rotation portion of the ride). A manual restraint release may be provided to assist with evacuation and other situations.

With reference to FIGS. 7-13, the following discussion provides a more detailed description of the connector or connection assembly of the invention. Prior to turning to that discussion, though, it may be useful to summarize that the new rides described herein allow all guests to experience a ride while in a vertical position and also in a flying or prone/near-prone position and positions in between (at least in some embodiments). Guests have control in some embodiments of arm height and angle through an interactive device such as a button, lever, joystick, or the like. While powered actuators and other similar devices may be used to control pivoting of the vehicle body, some preferred embodiments use a mechanical linkage as part of the connection assembly that pitches the vehicle body and/or seats forward such as relative to radial movement caused by increasing the angle of the support arm and/or increasing/decreasing the angular velocity of the drive assembly about its center axis.

Referring to FIGS. 7-13, an embodiment of a vehicle 710 is illustrated in further detail, and the vehicle 710 may be used with the rides shown and operated as described in FIGS. 1-6. Specifically, the vehicle 710 is connected to the radial arm 120 by a connection or linkage assembly 720 that provides the flight experience to passengers. The connection assembly 720 includes a mounting plate or structure 722 for mating with the end 124 of the radial arm 120 and rigidly attaching the vehicle 710 to the arm 120 and associated drive (not shown in FIGS. 7-13). The connection assembly 720 includes an extension, strut, or arm 723 that positions the vehicle outward a distance from the end 124 of the arm 120 to provide space or an envelope for movement in two directions (e.g., radially or curvilinear as well as revolution or pivoting about a pitch axis (e.g., axis 810 shown in FIG. 8)). The arm 723, hence, is typically 2 to 4 feet in length or longer and is selected and designed to be able to support the weight of the vehicle 710 as well as passengers with a desired factor of safety (e.g., loaded as a cantilever beam and attached at end plate 722).

The body 730 may further include a nacelle 732 and other features such as decorative elements 734 (e.g., wings or other theme elements). The body 730 also includes additional frame members 739 as well as seats 736, restraints 738 and mounting components 820 for the restraints 738, which may be hidden/covered by nacelles 732. Special effect components such as lights/LEDs, fog/smoke generators (cold jet efflux effects and the like), and/or other desired effects such as audio devices may also be provided in nacelles 732. Additionally, interactive devices (not shown) may be provided as part of each body or nacelle to allow the user to control the height and pitch of the body and/or to interact additionally with the ride operation/functions.

The connection assembly 720 in the illustrated embodiment achieves the free flying experience by functioning to provide two interconnected degrees of freedom, and this is achieved in this example with a linkage arrangement such as a four-bar linkage. Part of this linkage in assembly 720 is provided by the pin 726 connection of the body or body frame 730 to the end 725 of arm 723. As shown with arrow 728, the pin mounting at 726 allows the attached portion or link 731 of the body 730 to have a curvilinear degree of freedom or to pivot in the radial direction relative to the center axis of the ride drive assembly such as if the body 730 is pendulum mounted or the pins 726 provide a pivot point for the body 730. During operation, when the arm 120 angle is increased the body 730 has a tendency to rotate or pivot 728 about pins in an inward direction (e.g., due to gravity). Angular velocity of the vehicle 710 when the arm 120 and attached vehicle 710 are rotated creates forces that counteract gravity. At lower rotation rates of the ride, the rotation or movement may still be inward until the forces of gravity are overcome at some transitional rotation rate where centripetal forces push or pivot 728 the vehicle 720 in the outward radial direction about pins 726.

Figure 7:
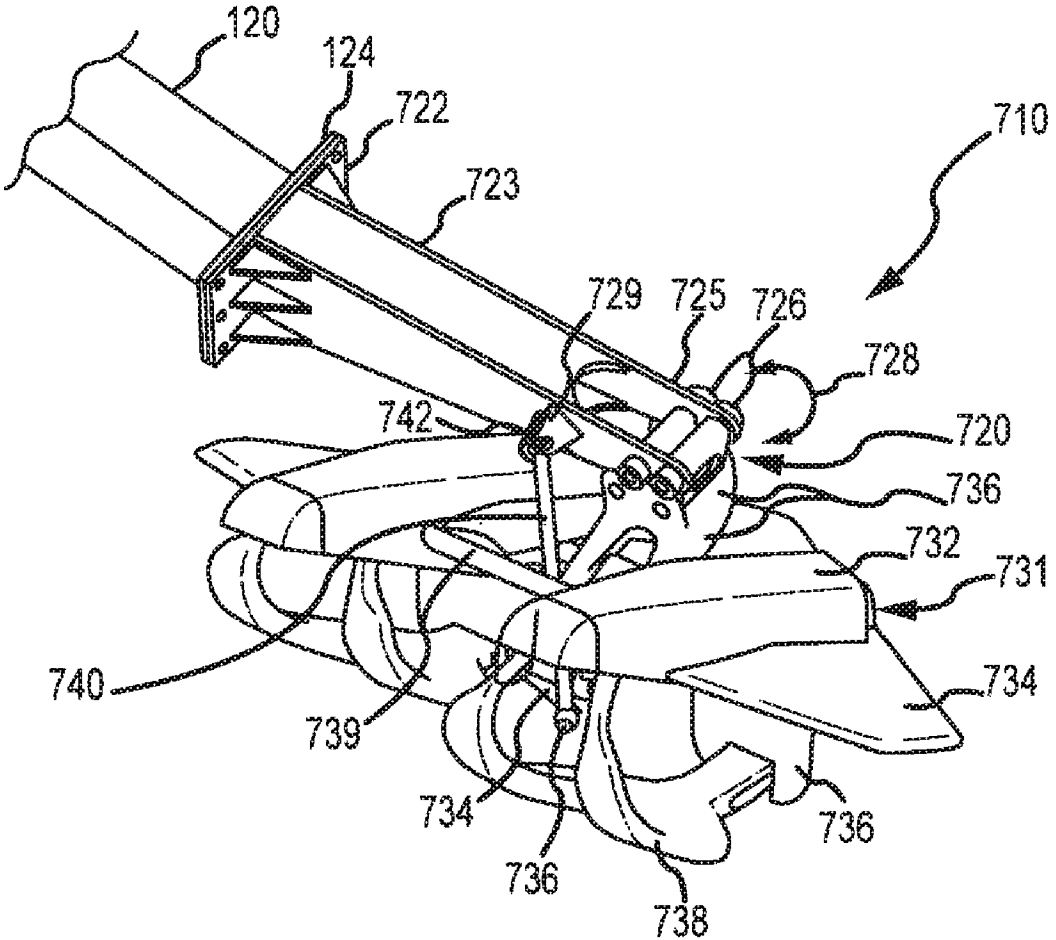
FIG. 7 is an enlarged perspective view of a vehicle or vehicle assembly of an embodiment of the invention, such as for use with the rides of FIGS. 1-6, illustrating more details of the free pivot connector assembly and vehicle body.
Figure 8:
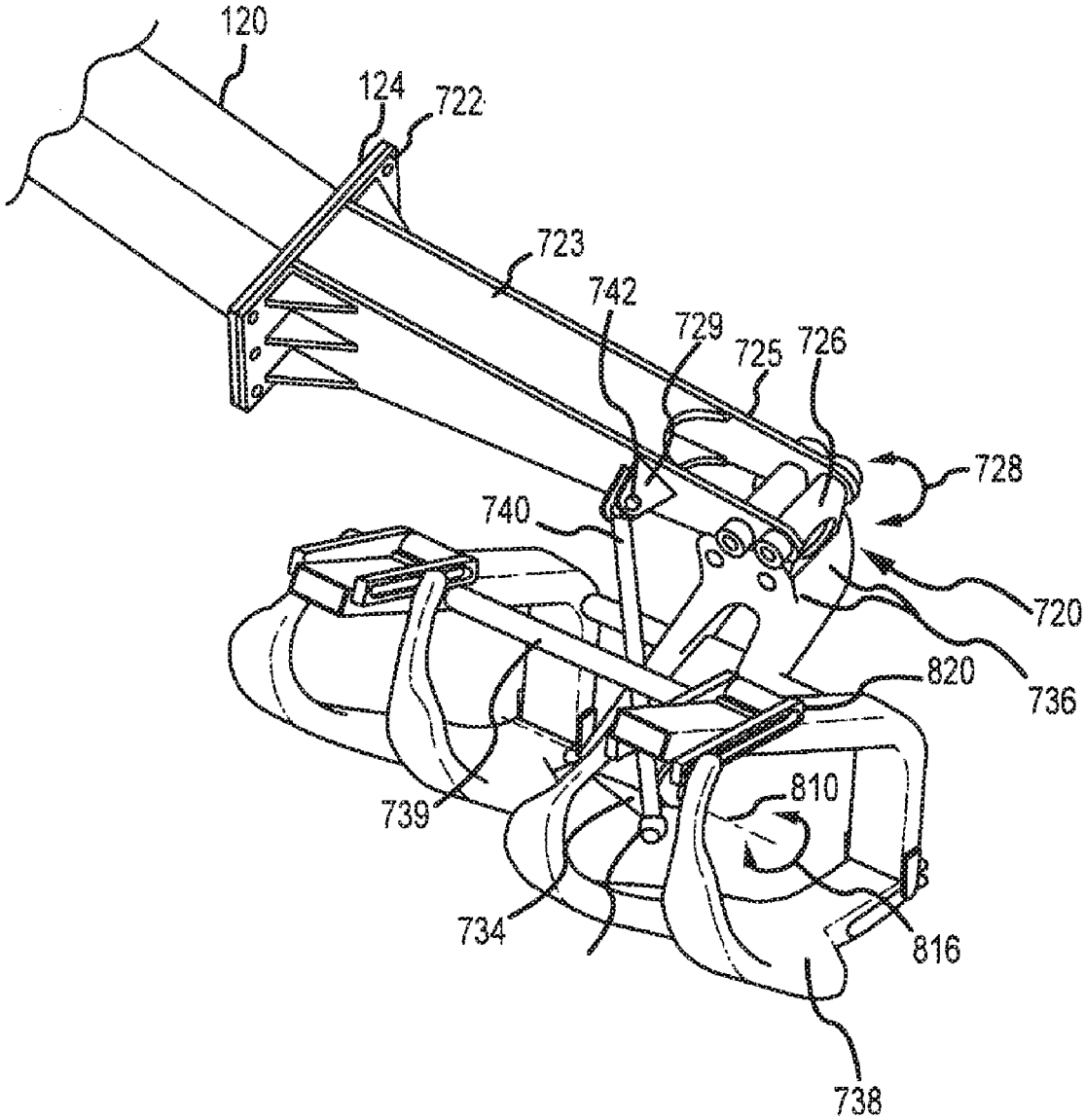
FIG. 8 is a perspective view similar to FIG. 7 of a vehicle with nacelles removed from the body to show restraint details and also showing a vehicle pitch axis or revolute degree of freedom axis about which the vehicle body is allowed to rotate (e.g., at higher support arm positions coinciding with higher angular speed of the vehicle)

With reference to FIGS. 7 and 8, the connection assembly 720 is adapted to translate this radial movement 728 or first degree of freedom into a pitch movement or revolute/second degree of freedom. The pitch or second direction pivoting 816 is shown in FIG. 8 to occur for the body 730 about an axis of the body or "pitch axis" 810, which passes through or is located near the center of mass of the body 730 (e.g., when it is empty or, more preferably, when it is loaded with passengers). To this end, the body portion or link 731 extends through the center of the body 730 to another link or crank arm 734. The crank arm/link 734 is connected at one end to bar or link 740, which extends backward, transverse to the link 731 toward the arm 723 where it is connected by structural element 729 near the arm end 725. Connectors 736 and 742 are, in one embodiment, spherical joints. These components of the connection or linkage assembly 720 function in unison to provide two degrees of freedom for the vehicle 710, and it may be worthwhile to further describe how these component operate to translate radial movement into a desired amount of pitch 816 of the vehicle about axis 810 to create the sensation of free flying. Note, also, that in this embodiment the pitch is created without powered components and, in practice, the connection assembly 720 provides the transition smoothly without a mechanical or jerky sensation for riders.

Figure 9:
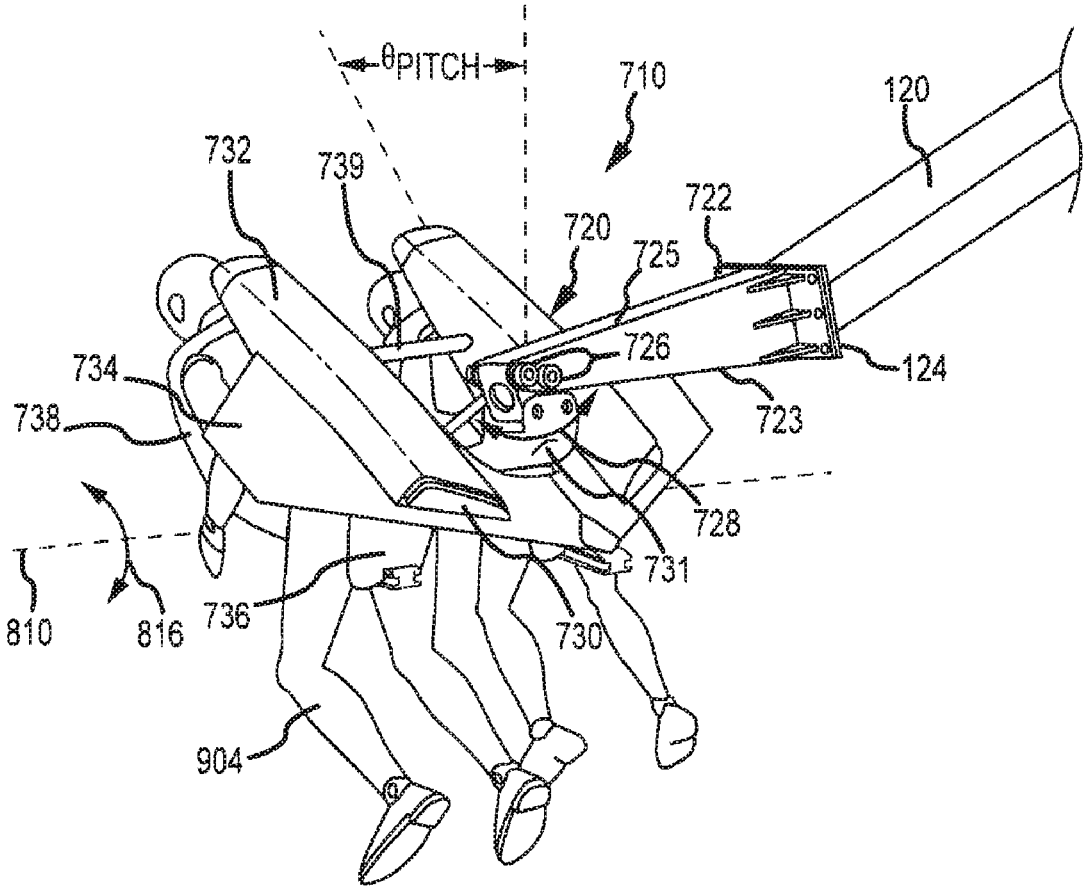
FIG. 9 is another perspective view similar to FIGS. 7 and 8 illustrating the two degrees of movement or freedom for the vehicle during operation of a ride.
Figure 10:
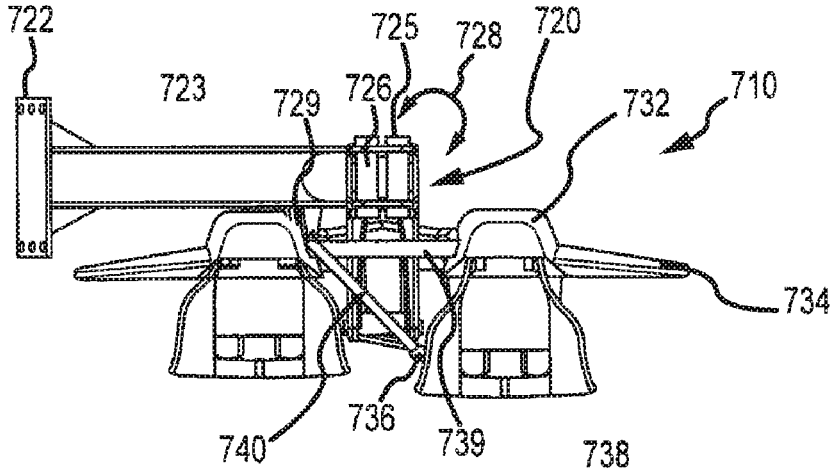
FIGS. 10-13 provide top, rear, front, and side views of the vehicle of FIGS. 7-9 providing further details for one useful connector and body assembly for practicing the invention.
Figure 11:
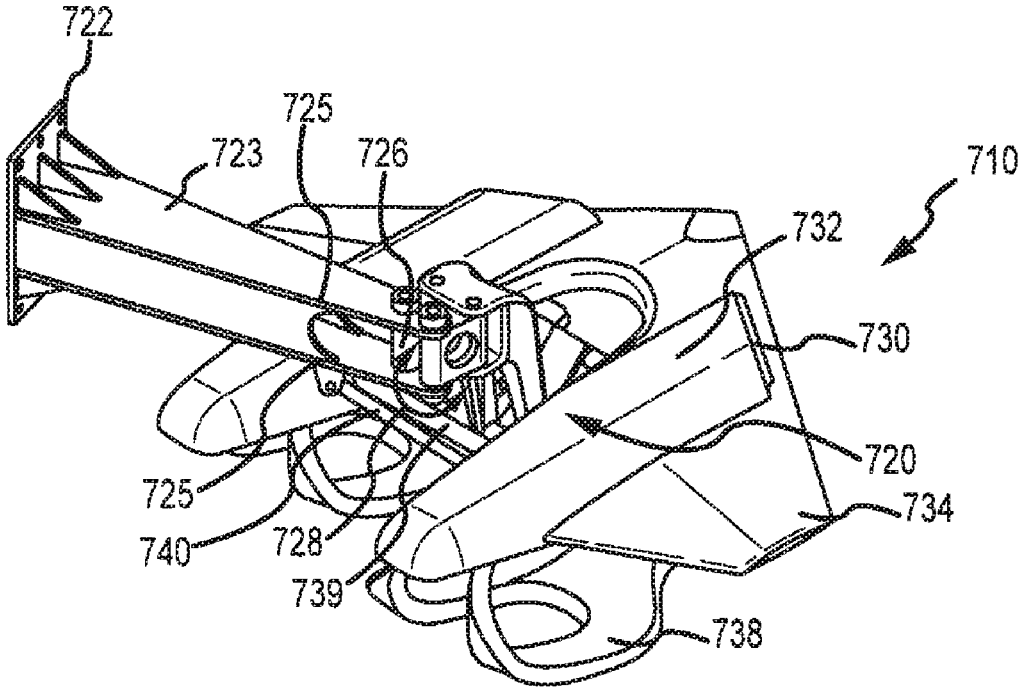
Figure 12:
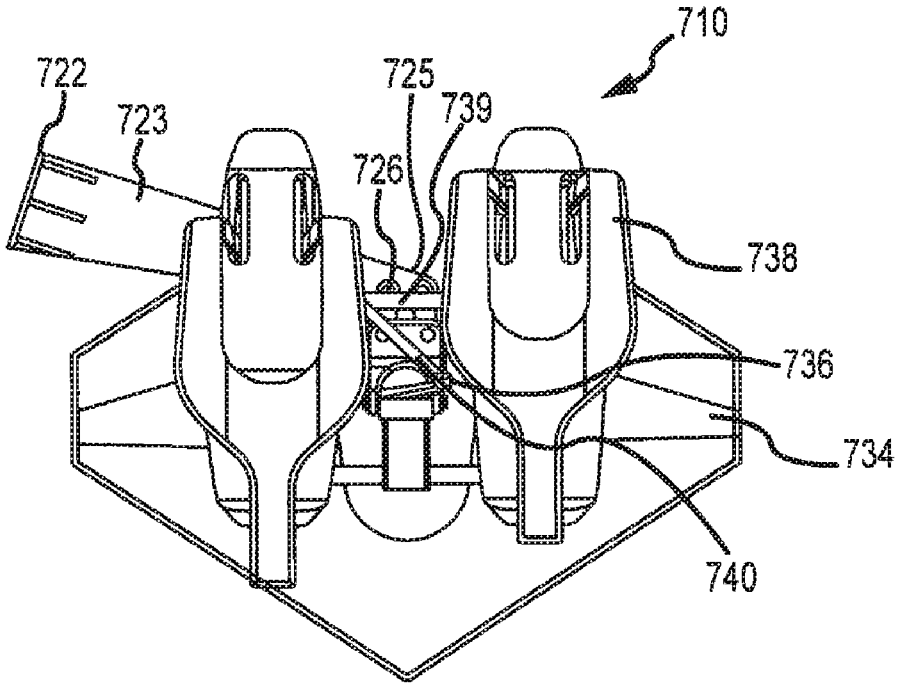
Figure 13:
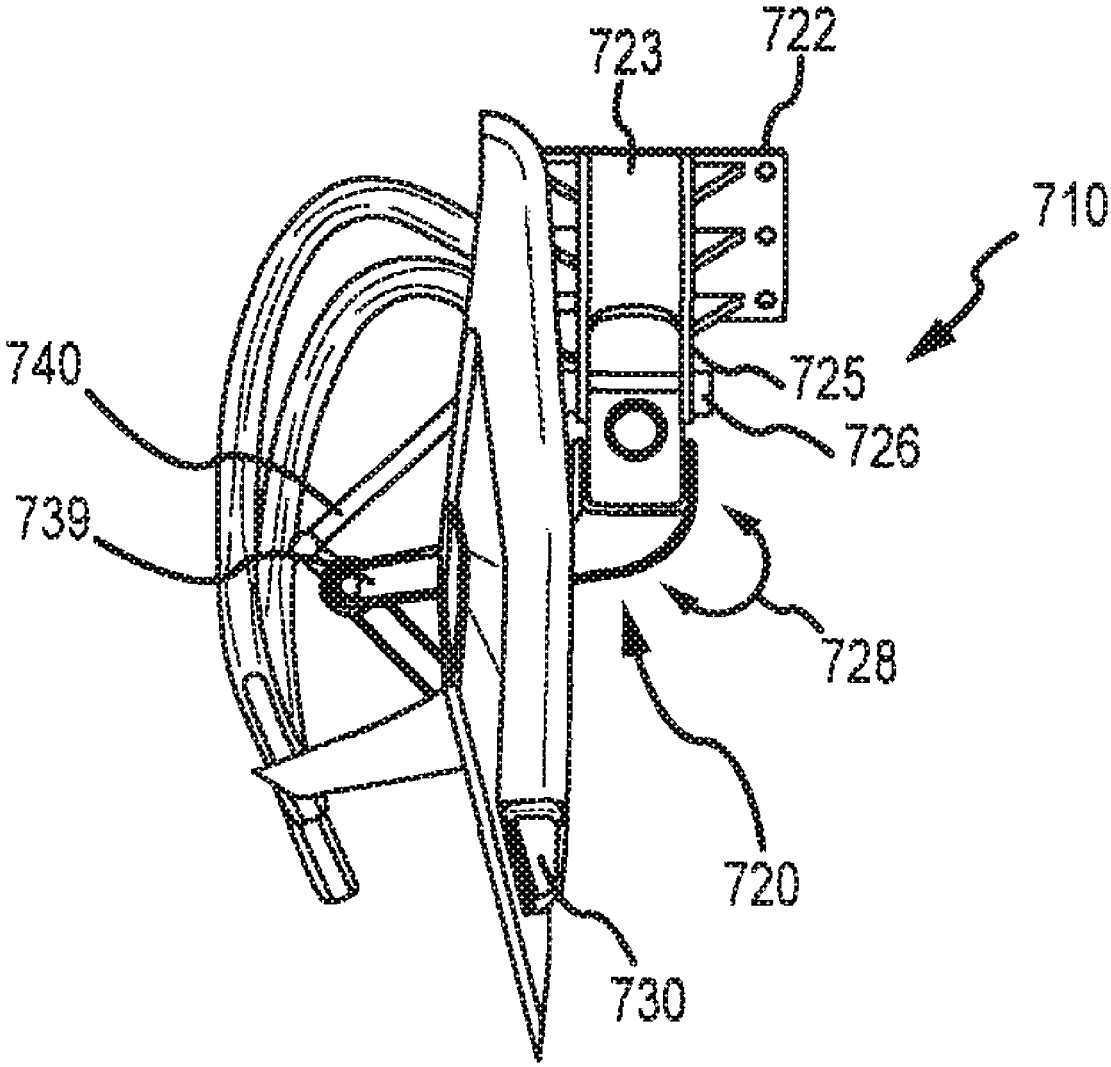

With reference to FIGS. 7-9, it can be seen that the entire ride vehicle 710 (e.g., bodywork, seats, and also passengers (not shown)) is connected to the radial arm 120 by a linkage 720. The linkage 720 has two interconnected degrees of freedom shown by arrows 728 and 816, and the overall linkage 720 may be thought of as a four-bar linkage or simply as an assembly of linkages that translate a radial or first degree of freedom into a differing or second degree of freedom (e.g., pitch 816 about axis 810). The first degree of freedom is a curvilinear degree of freedom or radial motion 728 for body 730 that is provided by the body attachment mechanism 726, which may be a single pin or be provided as its own four-bar linkage as shown with a first bar being the end 725 of arm, the pins allowing rotation of two additional side bars that are attached to body frame/portion or link 731.

The second degree of freedom or motion direction of the vehicle 710 may be considered a pitch movement as it pivots 816 the vehicle body 730 about the vehicle or pitch axis 810. Such pivoting 816 provides a forward pitching motion from the perspective of passengers 904 in vehicle 710 as it moves them from a relatively vertical position to a prone or more prone position. In other words, the pitch angle, $\theta_{PITCH}$, as measured from vertical to a planar portion of the body 730 such as the back of the seat or back support 736, is increased from zero to 10 degrees toward 90 degrees or more, with 40 to 60 degrees typically being passenger-comfort-imposed, upper limits of the pitch angle, $\theta_{PITCH}$, for many ride applications.

Link or bar 740 is provided with spherical joints 736, 742 at its ends, and it interconnects the two motions 728, 816 (e.g., translates radial motion into pitch or a first degree of freedom into a second degree of freedom). The connection assembly 720 may be designed to cause a forward pitch in response to an inward radial movement 728 as may be desirable for slowly rotating rides (e.g., rides rotating at less than about 15 RPM) in which the angular velocity is not great enough for centripetal force to overcome gravity. In other applications, the angular velocity may be great enough such that it may be desirable to have outward radial motion 728 translated into forward pitch. The illustrated embodiment of vehicle 710 is configured for slower revolution rates provided by the center drive assembly, and, hence, inward radial movement 728 in response to an increased arm angle is translated into a forward pitch. Specifically, a forward pitch 816 or increase of pitch angle, $\theta_{PITCH}$, of the vehicle body 730 is caused when the vehicle body 730 moves inboard 728 due to motion of linkage or pivotal connection 726 because the link 740 acts upon the crank arm or link 734.

Pivotal connector or linkage 726 is positioned in the vehicle 710 such that its instant center of motion is a distance above the center of mass of the vehicle body 730 (such as 1 to 3 feet or more). As a result, the vehicle body 730 is suspended in a pendular fashion from the arm 723 and moves radially 728 in response to the combined acceleration vector produced by gravity and circular motion. At a typical round ride operational speed (e.g., less than about 10 RPM for example but not as a limitation), the centripetal acceleration is small compared to gravity, and the pendular effect causes inboard motion 728 of the vehicle body 730. This inboard motion 728 is translated into a corresponding amount of forward pitch 816. In some embodiments, such pitch occurs only at the full lift or maximum angle of the radial arm 120 while in other embodiments pitch angle, $\theta_{PITCH}$, increases from an initial pitch angle through a range of intermediary pitch angles to a maximum pitch angle as the arm is lifted from an initial height to a maximum height (e.g., as the angle of the arm 120 increases from an initial operating angle to a maximum operating angle). Likewise, as the vehicle body 730 moves back to its original position through outboard radial movement 728, the vehicle body 730 is caused to pitch backward to a lower pitch angle, $\theta_{PITCH}$, and also to a minimal pitch angle, $\theta_{PITCH}$, to facilitate ingress and egress when the arm 120 is lowered such as at the end of a ride. In some embodiments, the configuration of the vehicle 710 and its connection assembly 720 is such that range of motion of the overall linkage 720 is such that the vehicle body 730 does not pitch backward when the arm 120 is about horizontal (or some other angle relative to horizontal) or below horizontal, e.g., when the ride is in motion it may be desirable to limit backward pendulum motion or rocking.

As can be seen from FIGS. 7-13, connection assemblies such as assembly 720 are useful for constraining movement over a desired range and at certain times in a ride while also being effective for translating movement in one direction (e.g., a radial inward or outward movement) into movement in another direction (e.g., forward and backward pitch). For example, the connection assembly may be configured such that the vehicle body or its back rest portion is maintained relatively vertical during loading and unloading and during a first lift off motion in which the support arms or other structures are moved to an initial, non-loading height. The connection assembly may also be configured to retain this vertical or near vertical position at lower rotation rates and/or at lower angles of the support arm (such as at angles at or below horizontal or even some range of positive angles above horizontal). In an intermediary arm height and range of angles (such as 0 to 45 degrees or the like), the connection assembly may be configured to allow the vehicle to rotate radially inward (or outward) and translate this motion into forward pitch. Then, at an upper or maximum height position of the arm and associated upper angle limit (such as an angle in the range of 30 to 60 degrees or more), the connection assembly allows the maximum inward (or outward) radial rotation of the vehicle body and translates this into the maximum forward pitch of the vehicle body and its passengers. Such movements are reversed as the arm is lowered and/or the ride speed is reduced.

The connection assemblies function to connect the vehicle body to a rigid support arm, to provide two degrees of freedom, and to translate movement in one direction into movement in a second direction. The axes of these two degrees of movement are typically at least transverse and may be orthogonal in some cases. Specifically, radial movement about an axis passing through the pivotal connection of the body is about an axis that may be considered tangential to the circumference of the circle that the vehicle is rotated through by operation of the drive assembly. In contrast, the pitch movements are about a vehicle or pitch axis that extends through the vehicle toward the center of the drive assembly or its center axis, and, hence, these two axes about which the body moves are at least transverse and may be substantially orthogonal in some cases (although this is not required). The connection assembly may be characterized as a non-planar, 4-bar linkage (e.g., with reference to FIG. 7, the four links or bars would be the end 725 of arm 723, the pivotal connector or link 726, the body portion 731 with crank arm 734 at one end (or bell-crank), and link/bar 740 which may be considered a tie-rod). However, this is just one technique of practicing the invention, and the description provided here is intended to cover nearly any mechanism (typically non-powered) for providing two degrees of freedom/motion and translating motion in one direction (such as radial motion) into motion in a second direction (such as pitch or rotation about a second axis transverse to the axis of motion in the first direction). With this functionality and the examples provided by this description and accompanying figures in mind, one skilled in the art will readily imagine many other connection or linkage assemblies that may be used to achieve these functions.

A variety of pitch responses may be achieved in vehicles such as vehicle 710 shown in FIGS. 7-13. For example, the angular relationship between the radial arm 120 and the pivotal connector or linkage 726 may be altered to provide a differing pitch response or movement 816 in response to radial movements 728. In some cases, the ride drive assembly 110 shown in FIG. 1 is operable at a range of rotation speeds 118, and the amount of angular movement 728 and corresponding pitch response 816 will vary with the selected speed, which may be held relatively constant for a ride or varied during the ride to achieve a desired pitch in the vehicles. Altering the overall geometry of the connection assembly 720, of course, will also affect the pitch response such as by altering the location, length, angle, or other parameters of the link 740 relative to crank arm 734 and/or to arm 723. Additionally, modifying the support arms 120 to change their length (e.g., the radius of the circle in which the vehicles are rotated effects centripetal forces) and/or range of motion (e.g., to alter the angle of the arms) may be used to change pitch response such as by increasing or decreasing the amount of radial motion or inboard/outboard swing of the vehicle (e.g., 0 to 60 degrees may be reduced to 0 to 45 degrees which reduces the range of pitch angles while increasing to 0 to 90 degrees would increase the range of pitch angles). Numerous variables may be considered in designing rides and vehicles of the invention. In one application, it was assumed that the gross vehicle weight (e.g., vehicle plus passengers) is about 1000 pounds with about 600 pounds allowed for the passengers and 400 pounds for the vehicle. Altering the gross vehicle weight will also typically change the pitch response achieved with a particular linkage or connection assembly.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the connector assembly may include mechanical limits that limit the range of pivoting in the radial direction and/or about the pivot axis of the vehicle. Additionally, the connector assembly may also include powered components in some embodiments such as actuators to provide or assist the radial motion and/or the pivoting of the vehicle into and/or through the range of flying or pitch angles. For example, the connector assembly may provide a pendulum type mounting as shown in the attached figures but then combine this with an actuator to rotate the vehicle through the pitch angles such as in response to operation of the interactive mechanism or joystick by the passenger.

We claim:

1. A vehicle for use in an amusement park ride, the ride including a drive assembly for rotating about an axis and supporting a plurality of supports that extend outward from the axis, comprising:

a body with at least one seat for a passenger;

a connection assembly for attaching the body to one of the supports, wherein the connection assembly includes a linkage assembly allowing the body to pivot radially inward and outward relative to the drive assembly and, free of an input actuation from the one of the supports, translating the radial pivoting of the body into a rotation of the body about a pitch axis and wherein the pitch axis is transverse to an axis about which the radial pivoting occurs in the vehicle.

2. The vehicle of claim 1, wherein the pitch axis is proximal to a center of mass of the body.

3. The vehicle of claim 2, wherein the linkage assembly comprises a pivotal connector linking the body to the one of the supports and the radial pivoting axis passes through the pivotal connector.

4. The vehicle of claim 3, wherein the pivotal connector is spaced apart from the center of mass of the body, whereby the body is pivotally supported from above by the pivotal connector.

5. The vehicle of claim 1, wherein the linkage assembly comprises a four-bar linkage providing the body two degrees of freedom relative to the one of the supports.

6. The vehicle of claim 1, wherein the linkage assembly comprises an arm rigidly attached to the one of the supports and a connector vertically supporting the body upon the arm in a pendular manner allowing the body to move inboard toward the drive assembly and outboard away from the drive assembly based upon an angular orientation of the one of the supports and a rate at which the drive assembly rotates.

7. The vehicle of claim 1, wherein radial pivoting of the body about the pitch axis rotates a back rest portion of the body forward through a plurality of pitch angles measured from a vertical plane to the back rest portion of the body, the pitch angles selected from the range of about 0 degrees to about 90 degrees.

8. A vehicle for use in an amusement park ride, the ride including a drive assembly for rotating about an axis and supporting a plurality of supports that extend outward from the axis, comprising:

a body with at least one seat for a passenger;

a connection assembly for attaching the body to one of the supports, wherein the connection assembly includes a linkage assembly allowing the body to pivot radially inward and outward relative to the drive assembly and translating the radial pivoting of the body into a rotation of the body about a pitch axis, wherein the linkage assembly comprises an arm rigidly attached to the one of the supports and a connector vertically supporting the body upon the arm in a pendular manner allowing the body to move inboard toward the drive assembly and outboard away from the drive assembly based upon an angular orientation of the one of the supports and a rate at which the drive assembly rotates, the linkage assembly further comprising a bar attached to the arm at a first end with a first spherical joint and to a portion of the body at a second end with a second spherical joint.

9. The vehicle of claim 8, wherein the portion of the body comprises a crank arm and is distal to a portion of the body attached to the connector and wherein the bar extends transverse to the pitch axis.

10. A ride apparatus for providing passengers a flight experience, comprising:

a drive assembly including a structure rotatable about a central axis at one or more rotation speeds, the drive assembly further including a plurality of support arms extending outward from the structure; and a plurality of vehicles each mounted proximate to an end of one of the support arms distal to the drive assembly, wherein each of the vehicles comprises a body with a passenger seat and a connection assembly for mounting the vehicle to the support arm with two degrees of freedom of movement including a radial movement of the body occurring based upon an angle of the support arm and the rotation speed of the drive assembly structure and including a forward pitch of the passenger seat.

11. A ride apparatus for providing passengers a flight experience, comprising:

a drive assembly including a structure rotatable about a central axis at one or more rotation speeds, the drive assembly further including a plurality of support arms extending outward from the structure; and a plurality of vehicles each mounted proximate to an end of one of the support arms distal to the drive assembly, wherein each of the vehicles comprises a body with a passenger seat and a connection assembly for mounting the vehicle to the support arm with two degrees of freedom of movement including a radial movement of the body occurring based upon an angle of the support arm and the rotation speed of the drive assembly structure and including a forward pitch of the passenger seat, wherein the passenger seat comprises a substantially planar back support for supporting a passenger's back and wherein the forward pitch provided by the connection assembly is less than about 90 degrees as measured from a vertical plane and the back support.

12. The apparatus of claim 11, wherein the drive assembly operates to position the support arms in a minimum height operating position with the support arms at a first angle relative to horizontal and in a maximum height operating position above the minimum height operating position with the support arms at a second angle relative to the horizontal that is greater than the first angle and wherein the forward pitch is less than about 10 degrees in the minimum height operating position and wherein the forward pitch is between about 10 and 60 degrees in the maximum height position.

13. The apparatus of claim 12, wherein the rotation speeds are less than about 15 RPM and wherein the radial movement at the maximum height is an inboard rotation of the body toward the drive assembly, the connection assembly generating the forward pitch of the passenger seat in response to the radial movement.

14. The apparatus of claim 12, wherein the connection assembly comprises a connector for vertically supporting the body in a pendular manner to allow the radial movement and further comprises one or more linkages interconnected to translate the radial movement of the body into the forward pitch by rotating at least the passenger seat about an axis extending through the vehicle proximal to the center of mass of the body.

15. The apparatus of claim 12, wherein the vehicle further comprises a control mechanism operable by a passenger in the passenger seat to move the support arm supporting the corresponding vehicle between the minimum height operating position and the maximum height operating position and to intermediate positions therebetween.

16. The apparatus of claim 15, wherein the radial movement occurs concurrently with the movement of the support arm and wherein the connection assembly translates the radial movement into forward pitch of the passenger seats, whereby the forward pitch varies with the movement of the support arm.

17. A vehicle for use on round amusement park rides that rotate a plurality of supports about a central axis and that position the supports in more than one angular position, comprising:

a body with a passenger seat; and a connection assembly mounting the body proximate to an end of one of the supports, the connection assembly comprising a linkage assembly vertically supporting the body at a point above the center of mass of the body and allowing the body to move radially inboard and outboard based on the angular position of the one of the supports, wherein the linkage assembly pitches the body concurrently with and in a magnitude that corresponds to a magnitude and direction of the radial movement.

18. The vehicle of claim 17, wherein the linkage assembly pitches the body about a pitch axis extending through the vehicle proximate to the center of mass of the body, whereby a back support portion of the seat is moved through pitch angles as measured from vertical that are selected from the range of angles consisting of 0 to 90 degrees.

19. The vehicle of claim 18, wherein the linkage assembly comprises a connector that pivotally supports the body at the point about the center of mass of the body and the radial movement includes rotation about an axis extending through the connector transverse to the pitch axis, whereby the body is supported by the linkage assembly with at least two degrees of freedom.

20. The vehicle of claim 19, wherein the linkage assembly further comprises a rigid support member mounted to the one of the supports and supporting the pivotally supporting connector and wherein the linkage assembly further comprises a tie bar mounted to the rigid support at a first end with a spherical joint and mounted to the body at a second end with a spherical joint, whereby the tie bar acts at least in part to translate the radial movement of the body into the concurrently created forward pitch of the body.

* * * * *